US007278181B2

(12) United States Patent
Harris et al.

(10) Patent No.: US 7,278,181 B2
(45) Date of Patent: Oct. 9, 2007

(54) VACUUM CLEANER WITH AIR BLEED

(75) Inventors: David Stuart Harris, Monkton Farleigh (GB); Benjamin Evans, Peterborough (GB); Gordon James Howes, Bath (GB)

(73) Assignee: Dyson Technology Limited, Wiltshire (GB)

( * ) Notice: Subject to any disclaimer, the term of this patent is extended or adjusted under 35 U.S.C. 154(b) by 482 days.

(21) Appl. No.: 10/468,870

(22) PCT Filed: Feb. 12, 2002

(86) PCT No.: PCT/GB02/00609

§ 371 (c)(1),
(2), (4) Date: Feb. 23, 2004

(87) PCT Pub. No.: WO02/067746

PCT Pub. Date: Sep. 6, 2002

(65) Prior Publication Data

US 2004/0128789 A1 Jul. 8, 2004

(30) Foreign Application Priority Data

Feb. 24, 2001 (GB) ..... 0104675.4

(51) Int. Cl.
*A47L 9/06* (2006.01)

(52) U.S. Cl. ..... 15/421; 15/398; 15/353

(58) Field of Classification Search ..... 15/345, 15/421, 353, 393, 398, 402
See application file for complete search history.

(56) References Cited

U.S. PATENT DOCUMENTS

| | | | | |
|---|---|---|---|---|
| 1,468,467 | A * | 9/1923 | Farnsworth | 15/421 |
| 1,778,935 | A * | 10/1930 | Cranmer | 15/421 |
| 3,550,183 | A * | 12/1970 | Wolf | 15/421 |
| 4,091,496 | A | 5/1978 | Desrosiers et al. | |
| 4,976,005 | A | 12/1990 | Graye | |
| 5,920,954 | A | 7/1999 | Sepponen | |
| 6,032,328 | A | 3/2000 | Harmon et al. | |
| 6,334,234 | B1 * | 1/2002 | Conrad et al. | 15/351 |

FOREIGN PATENT DOCUMENTS

| | | |
|---|---|---|
| BE | 721 011 A | 3/1969 |
| DE | 1 628 562 A | 2/1971 |
| EP | 0 042 723 B1 | 8/1985 |
| FR | 1 434 272 A | 4/1966 |
| GB | 958445 A | 5/1964 |
| GB | 2 159 696 A | 12/1985 |
| GB | 2 315 231 A | 1/1998 |

(Continued)

*Primary Examiner*—Theresa T. Snider
(74) *Attorney, Agent, or Firm*—Morrison & Foerster LLP

(57) ABSTRACT

A vacuum cleaner comprises a cyclonic separator (116) for separating dirt and dust from an incoming airflow. A tool (300) and a suction conduit (114) connect the tool (300) to the separator (116). The tool (300) comprises a main air inlet aperture for engaging with a surface to be cleaned and a bleed air inlet (310) for allowing air to bleed into the suction path. The bleed air inlet (310) is located such that it is separate from the main inlet. The cross-sectional area of the bleed air inlet (310) is sufficiently large that, in use, the bleed air inlet (310) admits a sufficient quantity of air to maintain adequate separation efficiency in the separator of the cleaner even when the main air inlet is fully blocked.

16 Claims, 6 Drawing Sheets

FOREIGN PATENT DOCUMENTS

| | | | | |
|---|---|---|---|---|
| JP | 10211134 | A | | 8/1998 |
| JP | 10323303 | A | | 12/1998 |
| JP | 11-123164 | | * | 5/1999 |
| JP | 11-137487 | | * | 5/1999 |
| JP | 2000-93361 | | * | 4/2000 |
| WO | WO86/01240 | A1 | | 2/1986 |
| WO | WO94/00046 | A1 | | 1/1994 |
| WO | WO98/02080 | A1 | | 1/1998 |

* cited by examiner

VACUUM CLEANER WITH AIR BLEED

FIELD OF THE INVENTION

This invention relates to a vacuum cleaner.

BACKGROUND OF THE INVENTION

Vacuum cleaners are usually supplied with a range of tools for use with various cleaning situations that a user may encounter. An upright vacuum cleaner has a wide, floor-engaging cleaner head at the base of the cleaner which is used for general floor cleaning. A range of smaller tools may also be supplied with the machine. These are usually attached to the end of a flexible hose of the cleaner. The tools often include a crevice tool for use in narrow, confined spaces, a stair tool and an upholstery tool with a brush head. A cylinder or canister vacuum cleaner has a wide floor tool which is attached to the end of a cleaning wand for general floor cleaning and a similar range of smaller tools for use in other cleaning situations.

For any vacuum cleaner, it is important to maintain a good flow rate of air into the floor tool and along the suction path of the cleaner to maintain good cleaning performance. This is particularly important with a cleaner that relies on cyclonic or centrifugal separation as the flow rate of dust-laden air within the cyclonic separating chamber is an important factor in determining the efficiency of the dust separation. It is known for tools to include one or more bleed air inlets. As shown in FIG. 1, the air inlet of a crevice tool 10 has a flat portion 12, a notched portion 14 and an opening 15. The notched portion 14 ensures that some air flows into the tool 10 even when the flat portion 12 is sealed against a surface.

FIG. 2 schematically shows a known type of cyclonic vacuum cleaner. The vacuum cleaner 100 incorporates a floor tool 10 which is attached directly to a hose 114. The hose 114 is directly connected to dust-separating apparatus 116. The dust-separating apparatus 116 is a cyclonic separating apparatus using one or more cyclonic separation stages. Downstream of the dust-separating apparatus 116 is a pre-motor filter 120, followed by a fan 122 which is driven by a motor 124. A further filter 126 is located after the motor 124. A bleed valve 118 is located on the dust-separating apparatus. The bleed valve 118 is arranged to admit air into the separating apparatus when the flow of air along the airflow path is significantly reduced. The bleed valve can respond to the pressure along the airflow path reducing to a predetermined absolute value, or to the difference in pressure between two parts of the airflow path reaching a predetermined value.

In use, the motor 124 operates to activate the fan 122 which causes a flow of air to pass from the floor tool 10 to the dust-separating apparatus 116 via the hose 114. After separation has taken place, the airflow passes through the pre-motor filter 120, past the fan 122, past the motor 124 providing a cooling effect, and through the post-motor filter 126 before being expelled to the atmosphere. A bleed valve 118 is arranged such that, if the pressure within the dust-separating apparatus 116, and particularly at the location within the dust-separating apparatus 116 at which the bleed valve 118 is placed, drops below a pre-determined value, the bleed valve 118 opens so as to allow air from the atmosphere to enter the cyclonic dust-separating apparatus in order to maintain an adequate airflow to effect separation. The prevention of the airflow from falling below a predetermined level helps to ensure that the motor 124 is adequately cooled so as to prevent any risk of overheating in the event of a blockage occurring in the airflow path upstream of the bleed valve 118.

However, the provision of a bleed valve, particularly a pressure differential bleed valve, adds considerable cost to the cleaner. Also, since the bleed valve has movable parts it is prone to wear and degradation over a period of use.

SUMMARY OF THE INVENTION

The present invention seeks to obviate the need for a bleed valve along the airflow path to the separator.

Accordingly, the present invention provides a vacuum cleaner comprising a cyclonic separator for separating dirt and dust from an incoming airflow, a tool and a suction conduit for connecting the tool to the separator, wherein the tool comprises a housing or body defining a suction path, the body having a main air inlet aperture for engaging with a surface to be cleaned and for allowing dirty air to enter the suction path, and a bleed air inlet for allowing air to bleed into the suction path, the bleed air inlet being located such that it is separate from the main air inlet aperture and wherein the bleed air inlet is permanently open and the bleed air inlet has a cross-sectional area such that, in use, it admits a sufficient quantity of air to maintain adequate separation efficiency in the separator of the cleaner when the main air inlet aperture is fully blocked.

The bleed air inlet admits a sufficient quantity of air to maintain adequate separation efficiency in the vacuum cleaner, even when the main air inlet aperture to the tool is fully blocked. This is particularly important in a vacuum cleaner which uses a set of small, parallel cyclonic separators where there is a risk that the separators could become blocked if the flow rate reduces below a critical value since the vortex cannot form. Also, the provision of a continuous flow of bled air through the tool into the suction path reduces or avoids sudden changes in airflow through the separation apparatus, which minimises the risk of dirt becoming re-entrained in the airflow through the separator. This extends the life of filters placed after the separation apparatus. The provision of the bleed air inlet can also avoid the need for a bleed air valve located further downstream along the suction path, which reduces the overall cost of the cleaner. The continuous provision of bled air also reduces the force that is required by a user to push the tool along a surface.

Preferably the bleed air inlet of the tool is located such that it is spaced from the main air inlet aperture and directs air into the suction channel towards the main aperture. In an embodiment, the tool includes an upper face, such as a portion of the tool body that faces generally away from the surface to be cleaned when the main inlet aperture is engaged on the surface. The bleed air inlet can be located on the upper face of the tool. This position of the bleed air inlet ensures that the bled air helps to agitate the surface that is being cleaned and thus results in more dirt, fluff and other debris being removed from the surface. Thus, it can be seen that the provision of the bleed air inlet improves the cleaning performance of the tool at all times, whether the main air inlet aperture is blocked or not.

Preferably the bleed air inlet is a plurality of apertures. These can be spaced across the tool. Each of the apertures of the bleed air inlet includes an inlet. In an embodiment, the tool is configured such that when the main air inlet aperture is engaged on the surface to be cleaned, the inlets to the apertures are disposed at relatively different heights with respect to the surface.

Preferably the bleed air inlet or inlets has a guide channel for guiding the flow of air.

In an embodiment, the main air inlet aperture generally occupies a plane, and it has been found that providing the bleed air inlet in a direction which is substantially perpendicular to the plane of the main air inlet aperture provides a particularly effective cleaning effect. The tool body has an outlet to allow flow to exit the tool from the suction path. It has also been found that the angle of the bleed air inlet with respect to the longitudinal axis of the air outlet of the tool body has an effect on the cleaning performance of the tool. By aligning the bleed air inlet such that it points away from the longitudinal axis of the outlet, a greater proportion of the bled air is likely to strike or to pass through the floor surface beneath the main air inlet. It has been found particularly beneficial to cause the bled air to flow through an obtuse angle, and preferably an angle approaching 180°.

In an embodiment, the tool also includes an agitator mounted within the body for agitating the surface to be cleaned. For example, the agitator may be a comb or brush. The bleed air inlet is preferably located such that it directs bled air towards a distal end of the agitator, where the agitator meets the surface.

In an embodiment, the body includes an outlet to allow flow to exit the tool from the suction path, and the bleed air inlet is directed at an angle with respect to the air outlet that is greater than 90°. Preferably, the cross-sectional area of the bleed air inlet is sufficient to allow, in use, a flow rate of at least 20 liters per second through the tool. For use in a vacuum wherein the cyclonic separator comprises a set of parallel cyclonic separators, the cross-sectional area of the bleed air inlet is sufficient to allow, in use, a flow rate above that at which the separators would become blocked.

The tool may be a configured as any one of a variety of types of vacuum tools. For example, the tool may be crevice tool or a stair tool.

BRIEF DESCRIPTION OF THE DRAWINGS

Embodiments of the invention will now be described, by way of example only, with reference to the accompanying drawings in which.

DETAILED DESCRIPTION OF THE DRAWINGS

Figure 5:
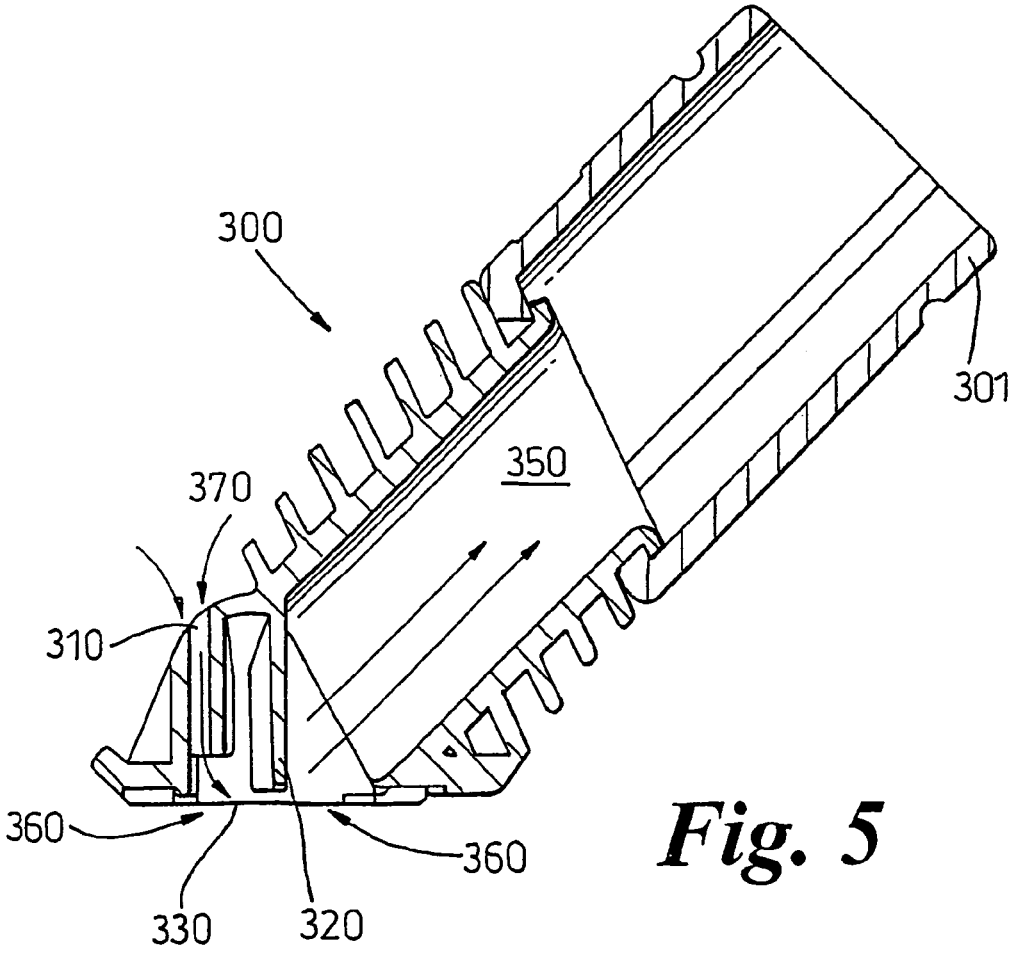
FIG. 5 is a cross-section through the tool of FIG. 3.
Figure 2:
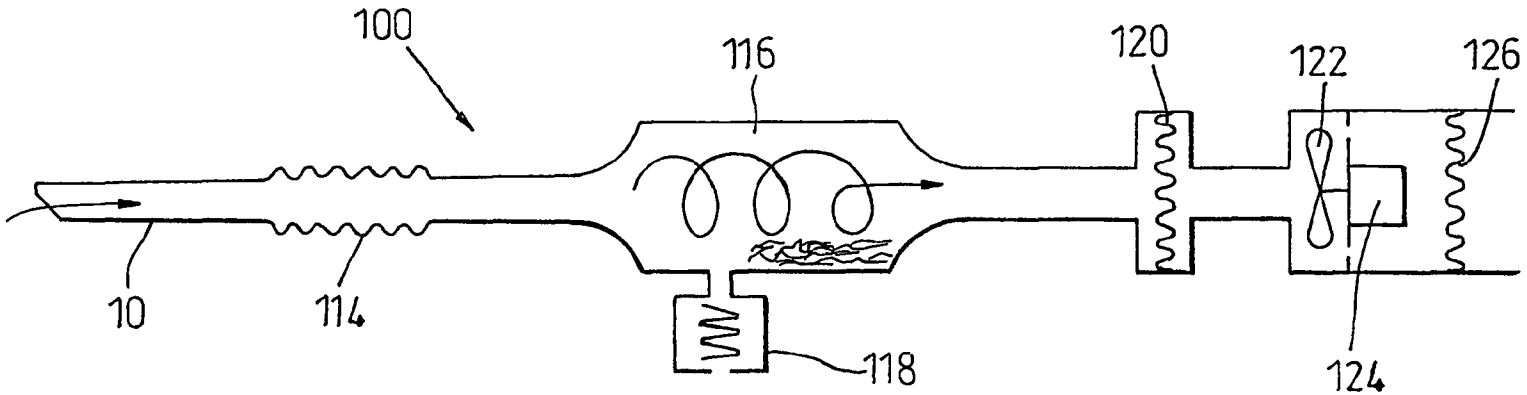
Fig. 2 (PRIOR ART)
FIG. 2 schematically shows the parts of a known cyclonic vacuum cleaner.
Figure 3:
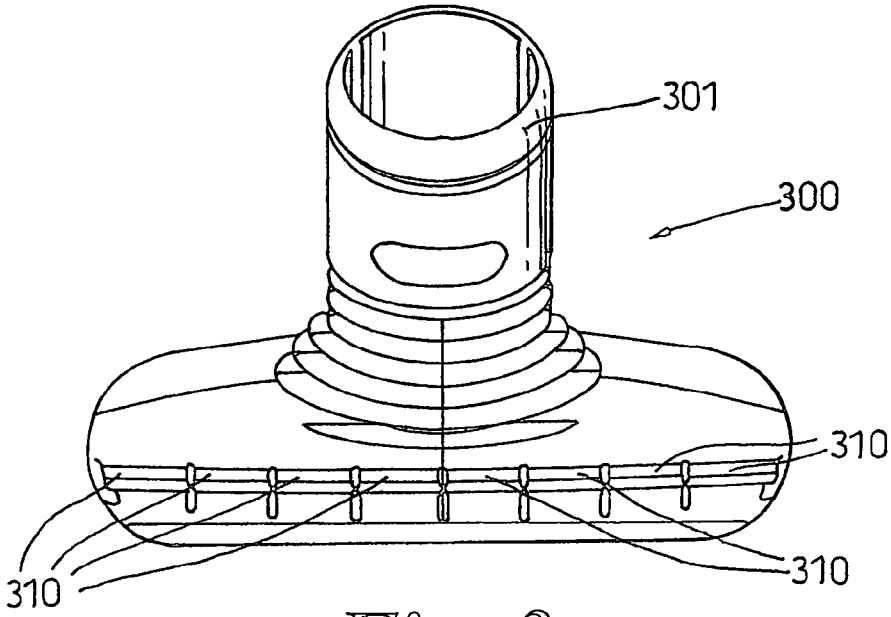
FIGS. 3 and 4 show a first embodiment of a tool which can be used in the present invention.
Figure 4:
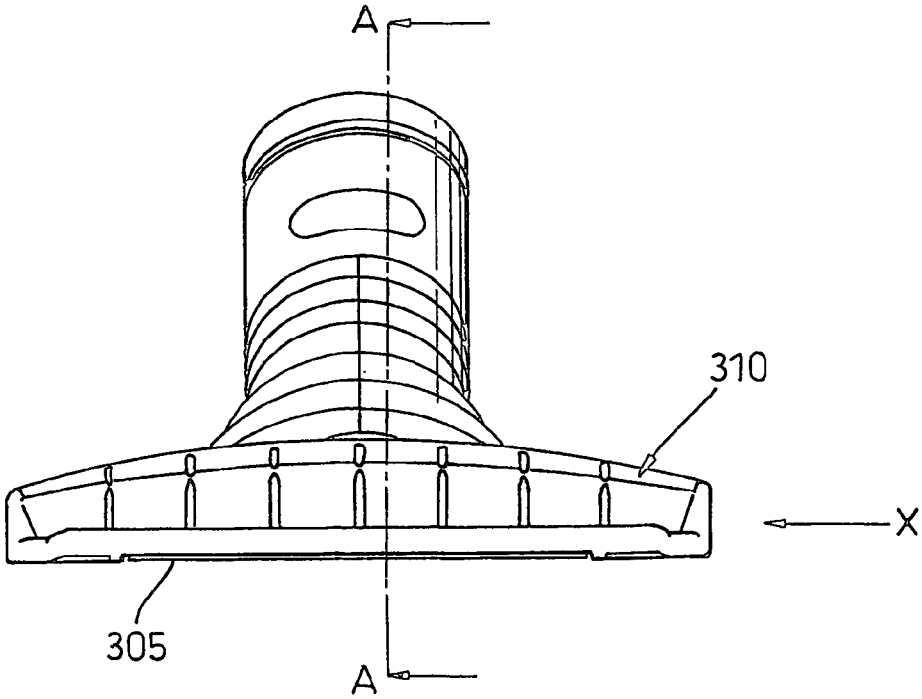

FIGS. 3 to 5 show a stair tool 300 which is used for cleaning stairs and areas which cannot readily be reached by a full-sized tool. FIG. 5 shows a cross-section along A-A of FIG. 4. The tool has a body with a neck 301 for connecting a suction hose or wand of a vacuum cleaner. The body defines a suction path or suction passageway 350. The lower face of the tool as shown in FIG. 4 has a main air inlet aperture 305, depicted in FIG. 5 as main suction opening 330, which allows air to enter the suction passageway 350. The main inlet aperture 305 or main suction opening 330 is intended to be pressed against a surface which is to be cleaned. In the embodiment of FIG. 5, the tool 300 includes an agitator, such as comb 320, which is positioned within the suction passageway 350 and extends downwardly towards the main suction opening 330. The comb has a formation of alternate fingers and openings when viewed in the direction X of FIG. 4, the fingers extending towards the inlet aperture 305 or suction opening 330. The cross-section of FIG. 5 shows the lowermost, distal end of one of the fingers of the comb. The comb serves to agitate the floor surface when it is pushed forwards and backwards across the surface. A set of bleed air inlets 310 is located across the width of the tool 300. The tool has an upper face that faces generally away from the surface to be cleaned when the main suction opening 330 is engaged thereon. Each of these inlets extends from the upper face towards the main suction opening 330. The inlets 310 in this tool are perpendicular to the plane of the main suction opening 330. A pathway exists between the lowermost part of the bleed air inlets and the main passageway 350, through the comb 320. This pathway exists even when the tool is pressed fully against a surface. Eight inlets are shown, spaced across the full width of the tool, but other numbers of inlets are possible. The inlets could be confined to only part of the width of the tool, but we have found best results are achieved when the inlets are spaced across the full width of the tool.

In use, air is drawn through the main suction opening 330. This airflow passes through the pile of a carpeted surface, carrying dirt and dust with it, and then flows along passageway 350 towards the cleaner. A secondary flow of air enters the tool via inlets 310. This secondary air or bled air is directed towards the surface which is pressed against the main suction opening 330. Some of the air will be drawn through the pile of the carpeted surface before flowing along passageway 350. Other air may flow directly from inlet 310 to passageway 350, bypassing the carpeted surface. The combination of air being drawn through the surface from the sides and above helps to increase the agitation of the floor surface. Also, air will still be able to freely flow into the tool via inlets 310 when the surface is very thickly piled and when there is little or no flow in direction 360.

Figure 6:
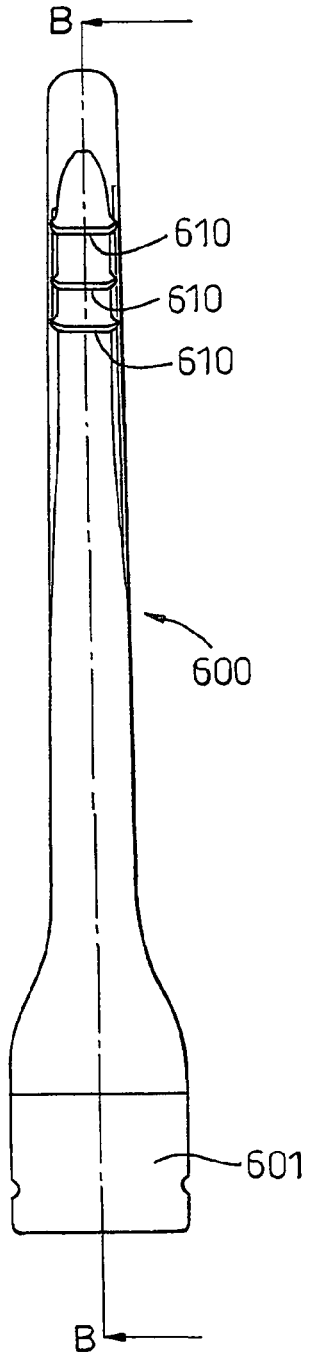
FIGS. 6 to 8 show a second embodiment of a tool which can be used in the present invention.
Figure 7:
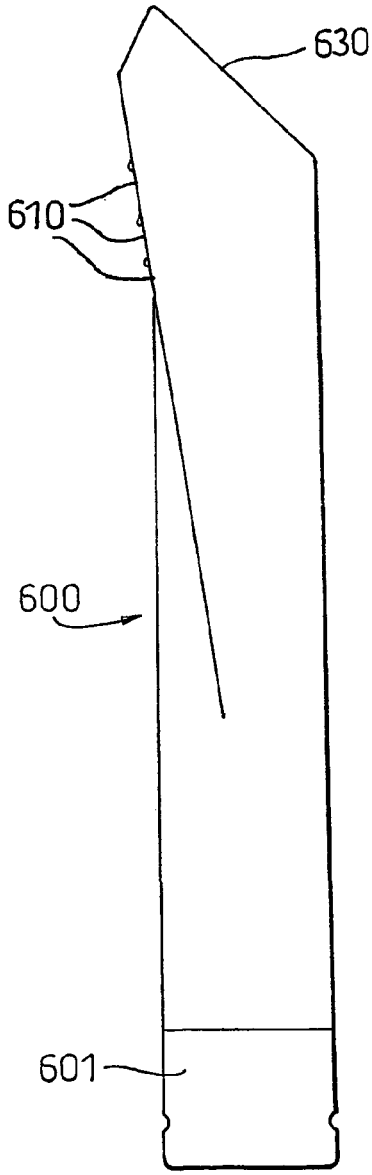
Figure 8:
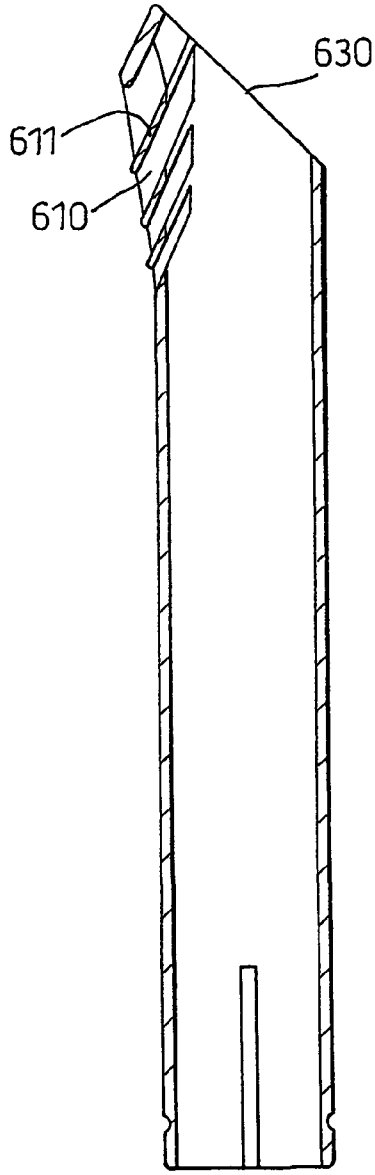

FIGS. 6 to 8 show a crevice tool, with FIG. 8 showing a cross-section along B-B of FIG. 6. A crevice tool is typically sued to clean confined areas. The tool has a body with a neck 601 for connecting to a suction hose or wand of a vacuum cleaner. The lower face of the tool has a main suction opening 630 which is intended to be pressed against a surface which is to be cleaned. A set of bleed air inlets 610 separated by vanes 611 is located on the lowermost part of the upper surface of the tool 600, the inlets being positioned one behind the other. Each of these inlets 610 extends from the upper face towards the main suction opening 630. The inlets 610 in this tool are set at an angle of around 70° to the plane of the main suction opening 630 although this angle could be perpendicular, as with the tool of FIG. 3, or some other angle. The inlets 610 are directed away from the longitudinal axis of the main passageway 650, thus ensuring that air which flows into the tool via inlets 610 is forced to make a 'u-turn' of 155° in order to flow out of the tool along the passageway 650. This is shown more clearly in FIG. 10. A pathway exists between the lowermost part of the bleed air inlets and the main passageway 650. This pathway exists even when the tool is pressed fully against a surface. Four inlets are shown, but other numbers of inlets are possible.

Figure 9:
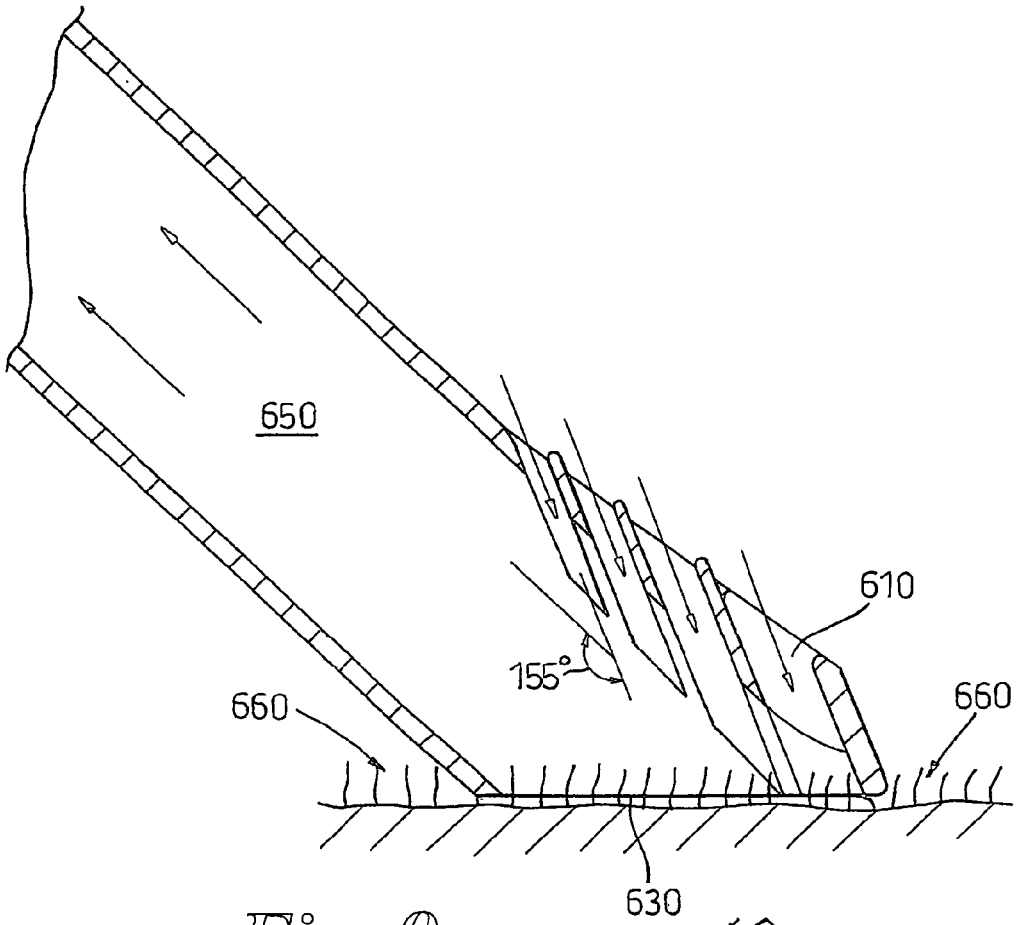
FIGS. 9 and 10 are cross-sections through the tool of FIG. 6.
Figure 10:
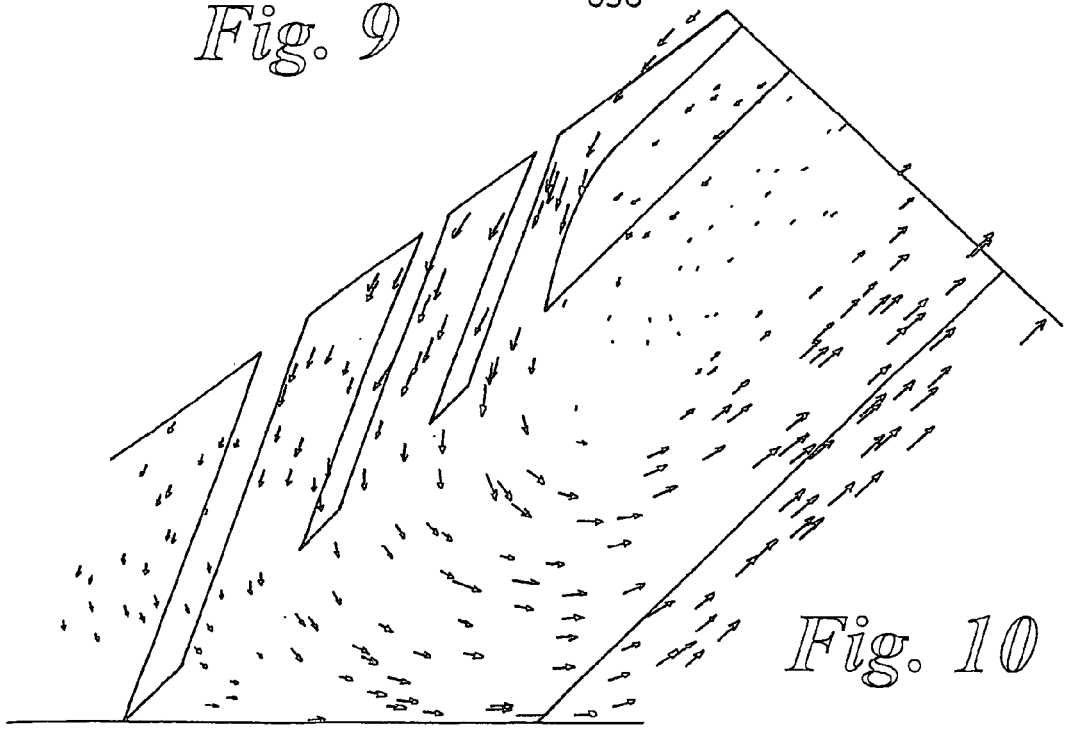

In use, this tool works in a similar manner to the tool of FIGS. 3-5. FIG. 9 shows the main directions of airflow and FIG. 10 shows a more detailed plot of airflow. Air is drawn through the main suction opening 630. This airflow passes through the pile of a carpeted surface, carrying dirt and dust with it, and then flows along passageway 650 towards the cleaner. A secondary flow of air enters the tool via inlets 610. This secondary air or bled air is directed towards the surface which is pressed against the main suction opening 630. Some of the air will be drawn through the pile of the carpeted surface before flowing along passageway 650. Other air may flow directly from inlet 610 to passageway 650, bypassing the carpeted surface. The combination of air being drawn through the surface from the sides and above helps to increase the agitation of the floor surface. Also, air will still be able to freely flow into the tool via inlets 610 when the surface is very thickly piled and when there is little or no flow in direction 660. The plot of FIG. 10 clearly shows that air is directed towards and, in part, through the surface to be cleaned rather than simply flowing directly from the inlet 610 to the passageway 650 and bypassing the surface.

Figure 11:
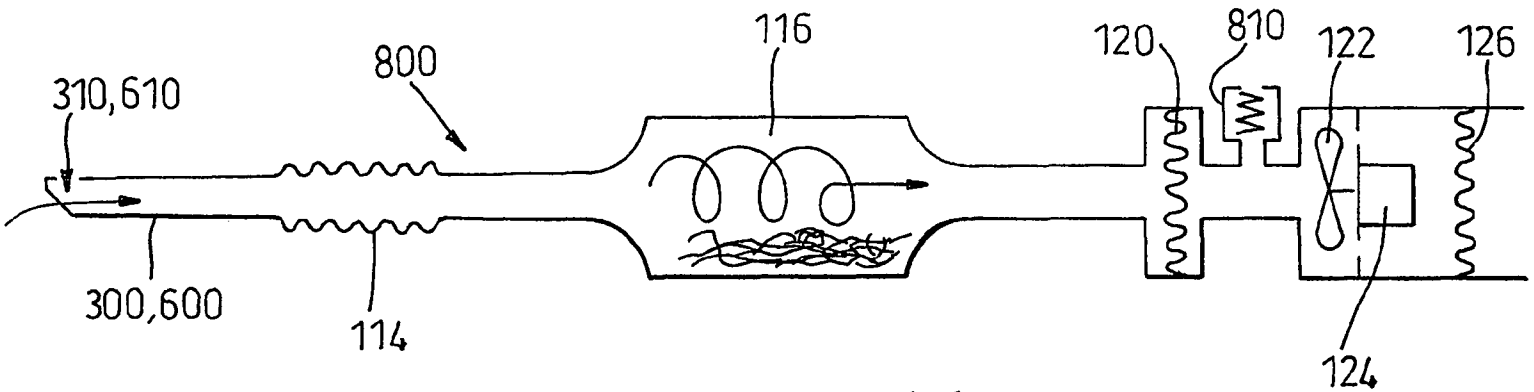
FIG. 11 schematically shows a cyclonic vacuum cleaner using the floor tools of FIGS. 3 to 10.

FIG. 11 schematically shows a cyclonic vacuum cleaner 800 which uses the tools described above.

The principle of cyclonic separation in domestic vacuum cleaners is described in a number of publications including EP 0 042 723. In general, an airflow in which dirt and dust is entrained enters a first cyclonic separator via a tangential inlet which causes the airflow to follow a spiral or helical path within a collection chamber so that the dirt and dust is separated from the airflow. Relatively clean air passes out of the chamber whilst the separated dirt and dust is collected therein. In some applications, and as described in EP 0 042 723, the airflow is then passed to a second cyclone separation stage which is capable of separating finer dirt and dust than the upstream cyclone. The airflow is thereby cleaned to a greater degree so that, by the time the airflow exits the cyclonic separating apparatus, the airflow is almost completely free of dirt and dust particles.

Figure 1:
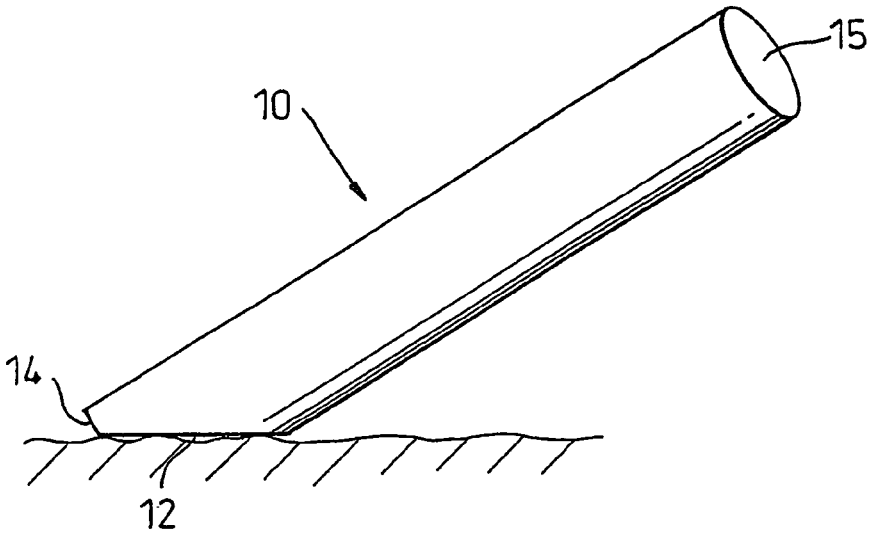
Fig. 1 PRIOR ART
FIG. 1 shows a known type of tool for a vacuum cleaner.

In FIG. 11, most of the parts of the cleaner are the same as shown in FIG. 1 and have the same reference numbers. However, the tool 10 has been replaced by one of the tools 300, 600 which have bleed air inlets. Since air can now flow along the airflow path even when the main inlet of the tool is blocked, effective separation can be maintained in separation apparatus 116 without the need for the bleed valve 118. A bleed valve 810 can be fitted downstream of the separator and pre-motor filter 120 to ensure that the motor will not overheat when the filter 120 becomes blocked. The cross-sectional area of the bleed air inlets 310, 610 is chosen such that, even when the main air inlet is fully sealed against a surface, the flow rate of air through the tool will be sufficient to maintain adequate separation efficiency in the dust-separating apparatus of the cleaner. It has been found that dimensioning the inlets 310, 610 to ensure a minimum flow rate of 20 liters per second through the tool provides good separation.

As an alternative to what is shown in FIG. 11, the bleed valve 118 of FIG. 1 could be used in its original position along with the tools 300, 600. The increased cleaning performance of the tools provides a beneficial effect, and the bleed valve 118 opens in the event that a blockage occurs somewhere between the tools 300, 600 and the dust-separating apparatus.

Figure 12:
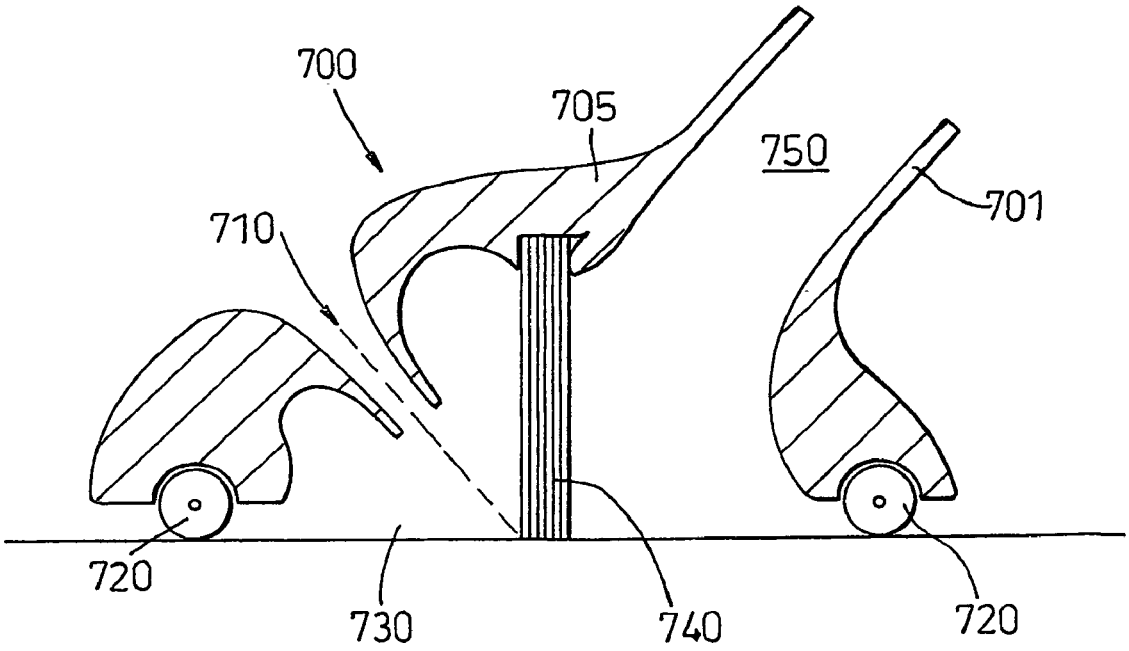
FIG. 12 shows a further tool which can be used in the invention.

FIG. 12 shows a cross-section through a further embodiment of a tool. The tool has a body 705 with a neck 701 for connecting to a suction hose or wand of a vacuum cleaner. The body defines a suction path therethrough. The lower face of the tool has a main air inlet aperture or main suction opening 730 which is intended to be pressed against a surface which is to be cleaned, the main suction opening allowing air to enter the suction path. A set of bleed air inlets 710 are located on the lowermost part of the upper surface of the tool 700. Each of these inlets 710 extend from the upper face towards the main suction opening 730. This embodiment differs from those previously described in that a brush 740 is positioned within the housing and extends towards the plane of the suction opening 730. The bleed air inlets 710 are configured such that bled air is generally directed toward a distal end of the agitator. For example, in the embodiment illustrated in FIG. 12, the bled air will strike the carpet at the base of the brush, where the distal end of the brush meets the surface to be cleaned, thus subjecting the surface to agitation by both the brush and the bled air. The inlets 710 in this tool are set at an angle of around 45-60° to the plane of the main suction opening 730, although this angle could be varied. A pathway exists between the bleed air inlets and the main passageway 750, through the brush 740. This pathway exists even when the tool is pressed fully against a surface. Rollers 720 are mounted to the lower surface of the tool 700 to minimise the 'push force' which a user must exert to move the tool. Other parts of the lower surface of the tool which may come into contact with the surface can be coated with a low-friction material such as PTFE to further reduce resistance.

The invention claimed is:

1. A vacuum cleaner comprising a cyclonic separator for separating dirt and dust from an incoming airflow, a tool, and a suction conduit for connecting the tool to the separator, wherein the tool comprises a body defining a suction path, the body having a main air inlet aperture for engaging with a surface to be cleaned and for allowing air to enter the suction path, and a bleed air inlet for allowing air to bleed into the suction path, the bleed air inlet being located such that it is separate from the main air inlet aperture and wherein the bleed air inlet is permanently open and the bleed air inlet has a cross sectional area such that, in use, it admits a sufficient quantity of air to maintain adequate separation efficiency in the separator of the cleaner when the main air inlet aperture is fully blocked.

2. The vacuum cleaner according to claim 1 wherein the bleed air inlet of the tool is located such that it is spaced from the main air inlet aperture and directs air into the suction conduit towards the main air inlet aperture.

3. The vacuum cleaner according to claim 1 wherein the tool includes an upper face, and wherein the bleed air inlet is located on the upper face of the tool.

4. The vacuum cleaner according to claim 1 wherein the bleed air inlet comprises a plurality of apertures.

5. The vacuum cleaner according to claim 4 wherein the plurality of apertures are spaced across the tool.

6. The vacuum cleaner according to claim 4 wherein each of the apertures includes an inlet, such that when the main air inlet aperture is engaged on the surface to be cleaned, the inlets to the apertures are disposed at respectively different heights relative to the surface.

7. The vacuum cleaner according to claim 1 wherein the bleed air inlet has a guide channel for guiding the flow of air.

8. The vacuum cleaner according to claim 1 wherein the main air inlet aperture generally occupies a plane, and wherein the bleed air inlet is directed in a direction which is substantially perpendicular to the plane of the main air inlet aperture.

9. The vacuum cleaner according to claim 1 further comprising an agitator mounted within the body for agitating the surface.

10. The vacuum cleaner according to claim 9 wherein the bleed air inlet is located such that it directs bled air towards a distal end of the agitator.

11. The vacuum cleaner according to claim 9 wherein the agitator is a brush.

12. The vacuum cleaner according to claim 1 wherein the body includes an outlet to allow flow to exit the tool from the suction path and wherein the bleed air inlet is directed at an angle with respect to the air outlet that is greater than 90°.

13. The vacuum cleaner according to claim 1 wherein the cross-sectional area of the bleed air inlet is sufficient to allow, in use, a flow rate of at least 20 liters per second through the tool.

14. The vacuum cleaner according to claim 1 wherein the cyclonic separator comprises a set of parallel cyclonic separators and the cross-section area of the bleed air inlet is sufficient to allow, in use, a flow rate above that at which the separators would become blocked.

15. The vacuum cleaner according to claim 1 wherein the tool is a crevice tool.

16. The vacuum cleaner according to claim 1, wherein the tool is a stair tool.

* * * * *